US012798636B2

(12) United States Patent
Li et al.

(10) Patent No.: US 12,798,636 B2
(45) Date of Patent: Nov. 17, 2026

(54) METHOD AND RAIL VEHICLE FOR DETECTION OF A FLAW OR FLAWS IN A RAILWAY TRACK

(71) Applicant: Technische Universiteit Delft, Delft (NL)

(72) Inventors: Zili Li, Delft (NL); Chen Shen, Delft (NL)

(73) Assignee: Technische Universiteit Delft, Delft (NL)

( * ) Notice: Subject to any disclaimer, the term of this patent is extended or adjusted under 35 U.S.C. 154(b) by 450 days.

(21) Appl. No.: 18/509,077

(22) Filed: Nov. 14, 2023

(65) Prior Publication Data

US 2024/0083476 A1 Mar. 14, 2024

Related U.S. Application Data

(63) Continuation of application No. PCT/NL2022/050155, filed on Mar. 23, 2022.

(30) Foreign Application Priority Data

Jun. 7, 2021 (NL) ..... 2028399

(51) Int. Cl.

| | |
|---|---|
| ***B61L 15/00*** | (2006.01) |
| ***B61K 9/10*** | (2006.01) |
| ***B61L 23/04*** | (2006.01) |

(52) U.S. Cl.

CPC ..... *B61L 15/0081* (2013.01); *B61K 9/10* (2013.01); *B61L 23/045* (2013.01); *B61L 23/047* (2013.01)

(58) Field of Classification Search

CPC ..... B61K 9/10; B61L 15/0081; B61L 23/045; B61L 23/047; B61L 23/044; B61L 23/042; B61L 23/04

See application file for complete search history.

(56) References Cited

U.S. PATENT DOCUMENTS 11,879,814 B2 * 1/2024 Kaynardag ..... G01N 29/2418
11,958,513 B2 * 4/2024 Yamaguchi ..... B61K 13/00
(Continued)

FOREIGN PATENT DOCUMENTS

EP 2436574 A1 * 4/2012 ..... B61L 15/0081
EP 2750955 B1 10/2015
(Continued)

*Primary Examiner* — Cheng Lin

(74) *Attorney, Agent, or Firm* — Peacock Law P.C.; Justin R. Muehlmeyer; Daniel J. Berenger-Russell

(57) ABSTRACT

A rail vehicle having rail wheels accommodated to guide the rail vehicle along a railway track. Each of the wheels is connected to the vehicle by an intermediate axle box that includes at least one accelerometer. A measurement system includes a receiver for receiving signals from the at least one accelerometer, and a vehicle-railway track interaction model that estimates the expected signals from the at least one accelerometer. The receiver and the vehicle-railway track interaction model connect to a comparator to compare the measured signals and the expected signals from the at least one accelerometer. The comparator connects to a tuning portion of the measurement system, which tuning portion is arranged to adjust parameters of the vehicle-railway track interaction model so as to provide a closer fit of the estimation of the expected signals from the at least one accelerometer with the measured signals from the at least one accelerometer.

3 Claims, 2 Drawing Sheets

(56) References Cited

U.S. PATENT DOCUMENTS

| | | | | |
|---|---|---|---|---|
| 12,202,531 | B2 * | 1/2025 | Michel | G01P 7/00 |
| 2015/0291192 | A1 * | 10/2015 | Li | B61L 23/045 246/121 |
| 2020/0156676 | A1 * | 5/2020 | Chung | B61L 23/047 |
| 2021/0078619 | A1 * | 3/2021 | Morita | B61L 15/0027 |

FOREIGN PATENT DOCUMENTS

| | | | | | |
|---|---|---|---|---|---|
| JP | 2004090848 | A | * | 3/2004 | |
| JP | 2011245917 | A | * | 12/2011 | |
| WO | WO-2011019273 | A1 | * | 2/2011 | B61K 9/10 |
| WO | 2013032322 | A1 | | 3/2013 | |
| WO | WO-2015160300 | A1 | * | 10/2015 | G01M 5/0091 |
| WO | 2022260508 | A1 | | 12/2022 | |

* cited by examiner

METHOD AND RAIL VEHICLE FOR DETECTION OF A FLAW OR FLAWS IN A RAILWAY TRACK

CROSS-REFERENCE TO RELATED APPLICATIONS

This application is a continuation of International Application No. PCT/NL2022/050155, entitled "METHOD AND RAIL VEHICLE FOR DETECTION OF A FLAW OR FLAWS IN A RAILWAY TRACK", filed Mar. 23, 2022, which claims priority to Netherlands Patent Application No. 2028399, entitled "METHOD AND RAIL VEHICLE FOR DETECTION OF A FLAW OR FLAWS IN A RAILWAY TRACK", filed Jun. 7, 2021, and the specifications and claims thereof are incorporated herein by reference.

BACKGROUND OF THE INVENTION

Field of the Invention

The invention relates to a method and a rail vehicle for detection of a flaw or flaws in a railway track.

Background Art

EP 2 750 955 describes a rail vehicle having rail wheels accommodated to guide the rail vehicle along a railway track. Each of the wheels is connected to the vehicle by an intermediate axle box providing a bearing for the wheel. The axle box is provided with at least one accelerometer. A measurement system on or external of the vehicle includes a receiving portion for signals from the at least one accelerometer. For this purpose, the rail vehicle is provided with a noncontact vibrometer which is arranged to measure vibrational movement of the railway track surface, and the measurement system on or external of the vehicle is used for comparing railway track surface vibrations as measured with the noncontact vibrometer with vibratory signals from the at least one accelerometer.

As is described in EP 2 750 955, due to the interaction between the wheels of the train and the track, dynamic forces arise between the wheels and the rails which cause that the quality and performance of the components and the track system as a whole degrades. Also, the interfaces between the components degrades. The components which are subject to (gradual) degradation include the rails, the switches and crossings, the insulated joints, the rail pads, (loose and missing) fasteners, (damaged or hanging) sleepers, as well as their interfaces. Also, local poor ballast and slab quality are a concern.

There is a need for a quick and reliable system or method to detect degradation of the respective parts of the railway track early, so as to be able to initiate maintenance of these respective parts of the railway track before the degradation of the railway track becomes problematic. An object of the present invention is to enable detection of which parts of the railway tracks require maintenance. A connection degradation can also be understood as a deviation of a (new) construction compared with the original design.

BRIEF SUMMARY OF THE INVENTION

Embodiments of the present invention are directed to methods and railway vehicles as claimed in one or more of the appended claims and as described herein.

According an embodiment of the present invention, a measurement system comprises a vehicle-railway track interaction model which generates an estimation of the expected signals from the at least one accelerometer, and the receiving portion and the vehicle-railway track interaction model connect to a comparator to compare the measured signals and the expected signals from the at least one accelerometer. The comparator connects to a tuning portion of the measurement system, which tuning portion is arranged to adjust parameters of the vehicle-railway track interaction model so as to provide a closer fit of the estimation of the expected signals from the at least one accelerometer with the measured signals from the at least one accelerometer.

Embodiments of the present invention are also directed to a method for detection of a flaw or flaws in a railway track. A rail vehicle comprising at least one accelerometer in an axle box of the vehicle is moved along the railway track for exciting the railway into vibration. Signals from the at least one accelerometer are used for detection of a flaw or flaws in the railway track. The expected signals from the at least one accelerometer are estimated with a vehicle-railway track interaction model and compared with measured signals from the at least one accelerometer. Parameters of the vehicle-railway track interaction model are subsequently tuned so as to provide a closer fit of the estimation of the expected signals from the at least one accelerometer with the measured signals from the at least one accelerometer.

The reliability of the vehicle-railway track interaction model is thus continuously improved, and the accordingly tuned parameters of the vehicle-railway track interaction model thus provide a reliable indication that maintenance may be required. In comparison with prior art methods, the invention provides the advantage that the level of acceptable deterioration of the railway track and its respective parts can be scientifically determined beforehand, and needs not to be based on historical or experience-based data.

One of the other advantages of the invention is that no specific inspection vehicle is required for the implementation of the method of the invention. In the invention standard railway vehicles may be applied. This tremendously reduces costs, including the reduction of the costs of operation of the railway track itself because it can be more intensely used.

Preferably the vehicle-railway track interaction model includes a model of respective parts of the railway track selected from the group comprising rails, fasteners including rail pads, sleepers, ballast, and substructures. This enables the identification of the specific parts of the railway track that require maintenance.

It is found that best results can be achieved when the parameters of the vehicle-railway track interaction model comprise tuning parameters of respective parts of the railway track selected from the group comprising stiffness, inertia, damping, geometry irregularities.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more embodiments of the invention and are not to be construed as limiting the invention. In the drawings.

DETAILED DESCRIPTION OF THE INVENTION

Figure 1:
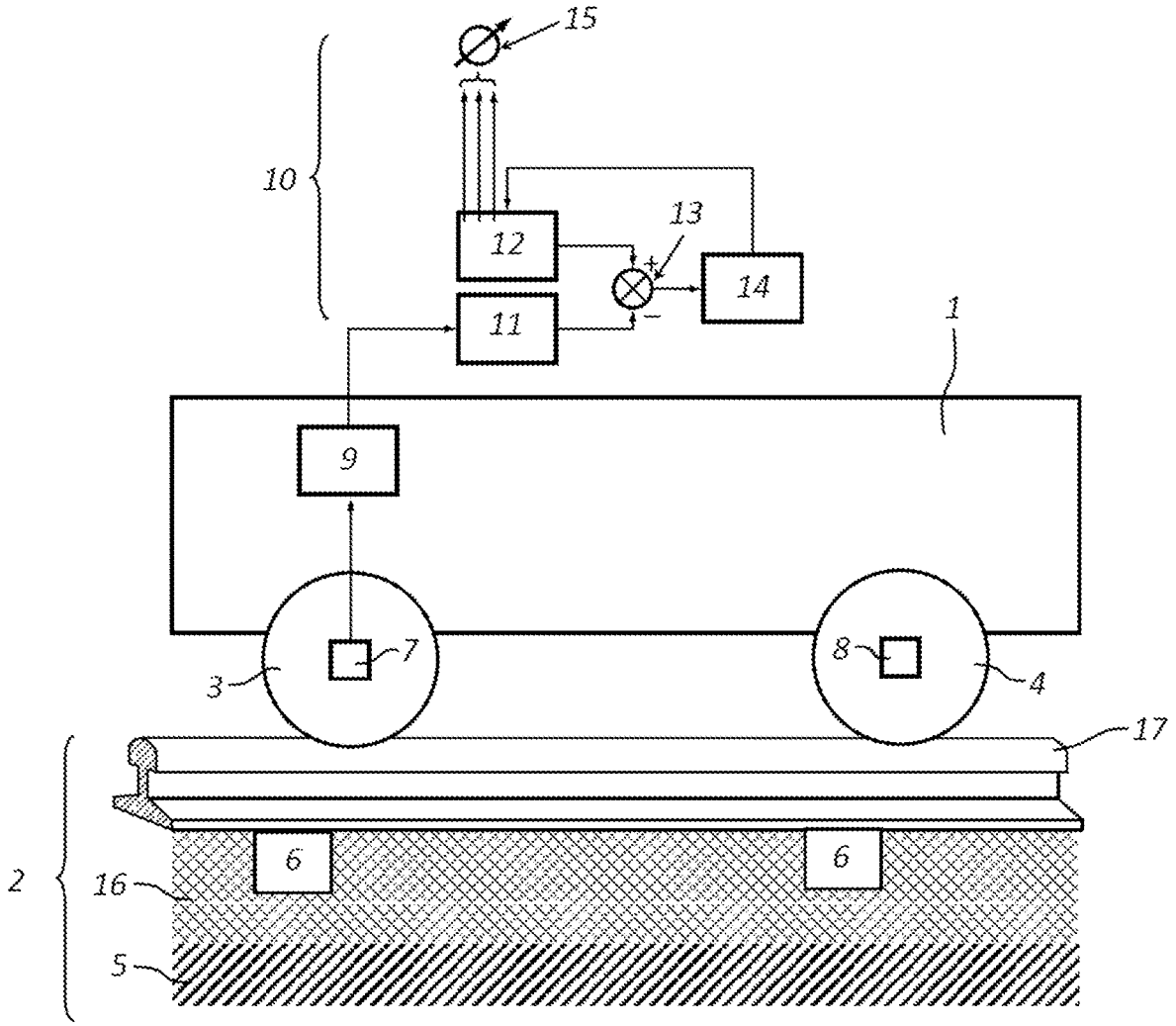
FIG. 1 is a schematic illustration of a railway vehicle according to an embodiment of the present invention.

Whenever in the figures the same reference numerals are applied, these numerals refer to the same parts.

FIG. 1 shows vehicle 1 that runs with a certain speed along track 2 with or without anomalies. Dynamic wheel-rail interaction is excited because moving wheels 3, 4 excite vibration of track 2, including rails 17 and substructure 5. If there is ballast 16 (or slab), this may be excited into vibration as well. The discrete support of sleepers 6 supporting rails 17 excites periodic vibration of rails 17 with a passing frequency and its harmonics corresponding to vehicle 1 speed and sleeper 6 spacing.

Vehicle 1 has axle boxes 7, 8 providing a bearing for wheels 3, 4. Accelerometer 9 provides signals corresponding to vibrations of the bearing of wheels 3, 4 and of the dynamic wheel-rail contact of wheels 3, 4 and rails 17, vibrations of wheels 3, 4 and rails 17 surfaces, as well as vibrations of railway 2 track itself.

The invention is based on the insight that different track parameters that alter over time and space, such as stiffnesses, will lead to different characteristic frequencies in the acceleration signal from accelerometer 9. Anomalies in railway 2 track will occur due to degradations caused by forces, stresses and strains in and between the components of railway 2 track, which forces, stresses and strains are the eventual result of the wheel-rail interaction. The degradations will cause the response of railway 2 track and its respective components to develop and deviate from their original response, depending on where and how the degradations have taken place. In this regard it is remarked that the different components and interfaces in railway 2 track system are designed to fulfil their respective functions in the system with different stiffness, damping and wavelength characteristics. Correspondingly they exhibit different frequency contents and magnitudes in their responses. The state of the system and of its components and interfaces can thus be assessed by a vibrational analysis of the responses, which develop in line with the degradation of the components and the interfaces and interaction between these components, resulting in varying input-response relationships.

Vehicle 1 comprises measurement system 10 on or external of vehicle 1 comprising a receiving portion 11 for signals from at least one accelerometer 9. A quantitative relationship between for instance the parameter stiffness of different parts of railway 2 track and the acceleration signal from accelerometer 9 can suitably be provided by vehicle-railway track interaction model 12. Accordingly, measurement system 10 further comprises vehicle-railway track interaction model 12 which generates an estimation of the expected signals from at least one accelerometer 9. Receiving portion 11 and vehicle-railway track interaction model 12 connect to comparator 13 to compare the measured signals and the expected signals from the at least one accelerometer 9, wherein comparator 13 connects to tuning portion 14 of the measurement system 10, which tuning portion 14 is arranged to adjust parameters of the vehicle-railway track interaction model 12 so as to provide a closer fit of the estimation of the expected signals from the at least one accelerometer 9 with the measured signals from the at least one accelerometer 9.

Figure 2:
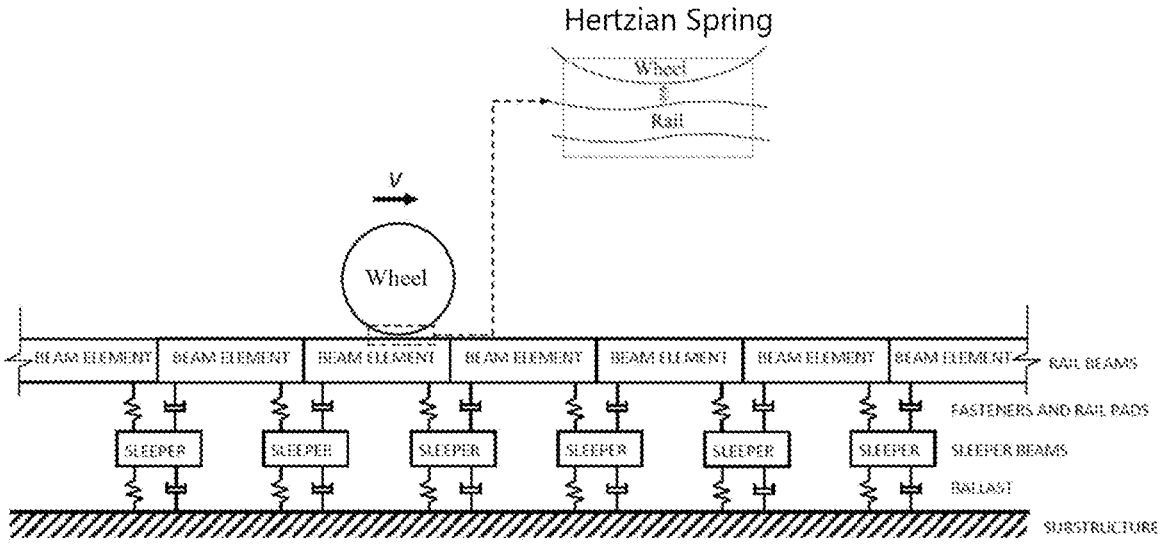
FIG. 2 is a schematic illustration of the vehicle-railway track interaction model used in connection with a railway vehicle according to an embodiment of the present invention.

Railway 2 track can for instance be represented by a two-layer discretely supported model, see FIG. 2. The rails and sleepers can be modeled as beam elements. Ballast and rail-pads can be modeled as discrete spring-damper pairs. The wheel can be simplified as a rigid mass. The load from the suspension springs is applied as a vertical load on the wheel. The wheel-rail contact can be modeled as a Hertzian spring. Accordingly, vehicle-railway track interaction model 12 includes a model of respective parts of the railway track selected from the group comprising rails, fasteners including rail pads, sleepers, ballast, and substructures. The parameters of the vehicle-railway track interaction model 12 comprises tuning parameters of respective parts of the railway track selected from the group comprising stiffness, inertia, damping, geometry irregularities. These parameters are available as is symbolized by reference 15 for deciding whether or not maintenance is required on the respective parts of the railway 2 track.

Although the invention has been discussed in the foregoing with reference to an exemplary embodiment of the method and vehicle of the invention, the invention is not restricted to this particular embodiment which can be varied in many ways without departing from the invention. The discussed exemplary embodiment shall therefore not be used to construe the appended claims strictly in accordance therewith. On the contrary the embodiment is merely intended to explain the wording of the appended claims without intent to limit the claims to this exemplary embodiment. The scope of protection of the invention shall therefore be construed in accordance with the appended claims only, wherein a possible ambiguity in the wording of the claims shall be resolved using this exemplary embodiment.

Embodiments of the present invention can include every combination of features that are disclosed herein independently from each other. Although the invention has been described in detail with particular reference to the disclosed embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference. Unless specifically stated as being "essential" above, none of the various components or the interrelationship thereof are essential to the operation of the invention. Rather, desirable results can be achieved by substituting various components and/or reconfiguration of their relationships with one another. The terms, "a", "an", "the", and "said" mean "one or more" unless context explicitly dictates otherwise.

The invention claimed is:

1. A rail vehicle comprising:

rail wheels accommodated to guide the rail vehicle along a railway track, wherein each of the wheels is connected to the vehicle by an intermediate axle box providing a bearing for the wheel, and the axle box comprising at least one accelerometer, a measurement system disposed on or external to the vehicle, the measurement system comprising a receiving portion for signals from the at least one accelerometer, and the measurement system comprising a vehicle-railway track interaction model which generates an estimation of the expected signals from the at least one accelerometer, wherein the receiving portion and the vehicle-railway track interaction model connect to a comparator to compare the measured signals and the expected signals from the at least one accelerometer, wherein the comparator connects to a tuning portion of the measurement system, which tuning portion is arranged to adjust parameters of the vehicle-railway track interaction model so as to provide a closer fit of the estimation of the expected signals from the at least one accelerometer with the measured signals from the at least one accelerometer, wherein the vehicle-railway track interaction model comprises a model of respective parts of the railway track selected from the group comprising rails, fasteners, rail pads, sleepers, ballast, slabs and substructures.

2. The rail vehicle according to claim 1, wherein the parameters of the vehicle-railway track interaction model comprise tuning parameters of respective parts of the railway track selected from the group comprising stiffness, inertia, damping, and geometry irregularities.

3. A method for detection of a flaw or flaws in a railway track, the method comprising:

moving a rail vehicle along the railway track for exciting the railway track into vibration, the rail vehicle comprising at least one accelerometer of an axle box of the vehicle;

using signals from the at least one accelerometer for detection of a flaw or flaws in the railway track;

estimating the expected signals from the at least one accelerometer with a vehicle-railway track interaction model, wherein the vehicle-railway track interaction model comprises a model of respective parts of the railway track selected from the group comprising rails, fasteners, rail pads, sleepers, ballast, slabs and substructures;

comparing the estimated expected signals with measured signals from the at least one accelerometer;

tuning parameters of the vehicle-railway track interaction model so as to provide a closer fit of the estimated expected signals from the at least one accelerometer with the measured signals from the at least one accelerometer.

* * * * *